US006978528B1

(12) United States Patent
Stallings

(10) Patent No.: US 6,978,528 B1
(45) Date of Patent: Dec. 27, 2005

(54) DRAIN BASKET SUPPORT TOOL

(76) Inventor: Quincy D. Stallings, 1343 Old Hwy. 82 East, Starkville, MA (US) 39759

( * ) Notice: Subject to any disclaimer, the term of this patent is extended or adjusted under 35 U.S.C. 154(b) by 0 days.

(21) Appl. No.: 10/944,489

(22) Filed: Sep. 20, 2004

(51) Int. Cl.[7] ..... B25B 27/14
(52) U.S. Cl. ..... 29/281.1; 294/1.1
(58) Field of Search ..... 29/281.1, 255, 29/282, 270, 278; 294/1.1, 86.12, 86.1, 86.4, 294/86.11

(56) References Cited

U.S. PATENT DOCUMENTS 2,956,461 A 10/1960 Anderson
D278,459 S 4/1985 Cook
5,090,276 A 2/1992 Groskey
5,103,698 A 4/1992 Delaney
5,927,589 A * 7/1999 Yang ..... 228/44.7
6,082,793 A * 7/2000 Gagnon ..... 294/1.1
6,474,199 B1 11/2002 Szasz
6,564,679 B1 5/2003 Llamas et al.
6,609,283 B1 * 8/2003 Somerville ..... 29/262
2004/0205963 A1 * 10/2004 Rubino et al. ..... 29/762

* cited by examiner

*Primary Examiner*—Lee D. Wilson

(57) ABSTRACT

A drain basket support tool includes a tubular housing that has a top end a bottom end. Each of a pair of rods extends through the tubular housing and each of the rods includes a pair of arms. Each of a plurality of extension members has a first end and a second end. Each of a plurality of couplers is adapted coupling together one of the arms and one of the first ends of the extension members such that their combined length may be selectively adjusted and the second ends abutted against side walls of a sink. A flexible tether is attached to one of the rods and extends downwardly out of the housing. A fastener attaches a weight to the tether. The bottom end of the housing is abutted against a drain basket to prevent its movement while it is either installed or removed from the sink.

6 Claims, 5 Drawing Sheets

DRAIN BASKET SUPPORT TOOL

BACKGROUND OF THE INVENTION

1. Field of the Invention

The present invention relates to plumbing tools and more particularly pertains to a new plumbing tool for securing a drain basket in place and stationary while it is either being removed from or secured to a sink.

2. Description of the Prior Art

The use of plumbing tools is known in the prior art. U.S. Pat. No. 6,474,199 describes a device that is attachable to a sink bottom with suction cups and which aids in the installation of a drain. U.S. Pat. No. 2,956,461 describes a wrench adapted for coupling to plumbing fixtures, and in particular to drain baskets. A device of similar construction is found in U.S. Pat. No. 6,564,679, which has a unique design adapted for the removal and installation of an appliance clutch.

While these devices fulfill their respective, particular objectives and requirements, the need remains for a device that may be attached to a drain basket to ensure that the drain basket is secured in its required position which it is either being removed or secured to a sink. This should include the ability to prevent the drain basket from rotating in a hands-free manner so that a plumber may easily connect or disconnect the drain basket's fittings.

SUMMARY OF THE INVENTION

The present invention meets the needs presented above by generally comprising a device for supporting a drain basket and coupler assembly during installation or removal of the drain basket and coupler assembly. The device includes a tubular housing that has a top end a bottom end. Each of a pair of rods extends through the tubular housing and each of the rods includes a pair of arms extending outwardly away from the tubular housing. The arms each have a free end. Each of a plurality of extension members is elongated and has a first end and a second end. Each of a plurality of couplers is adapted coupling together one of the free ends of the arms and one of the first ends of the extension members such that a length of each of the arms and an associated one of the extension members may be selectively adjusted. The extension members may be selectively extended such that the second ends abut side walls of a sink. A flexible tether has an upper end a lower end. The upper end is positioned within the tubular housing and attached to one of the rods. The lower end extends away from the rods and outward through the bottom end of the housing. A fastener is attached to the lower end of the tether. A weight is removably attached to the fastener. The bottom end of the housing is abutted against the drain basket and the tether extends through a central area of the drain basket such that the drain basket is secured in place. The tether is selectively extended through the coupler assembly so that the coupler assembly is supported on the tether between the weight and the drain basket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
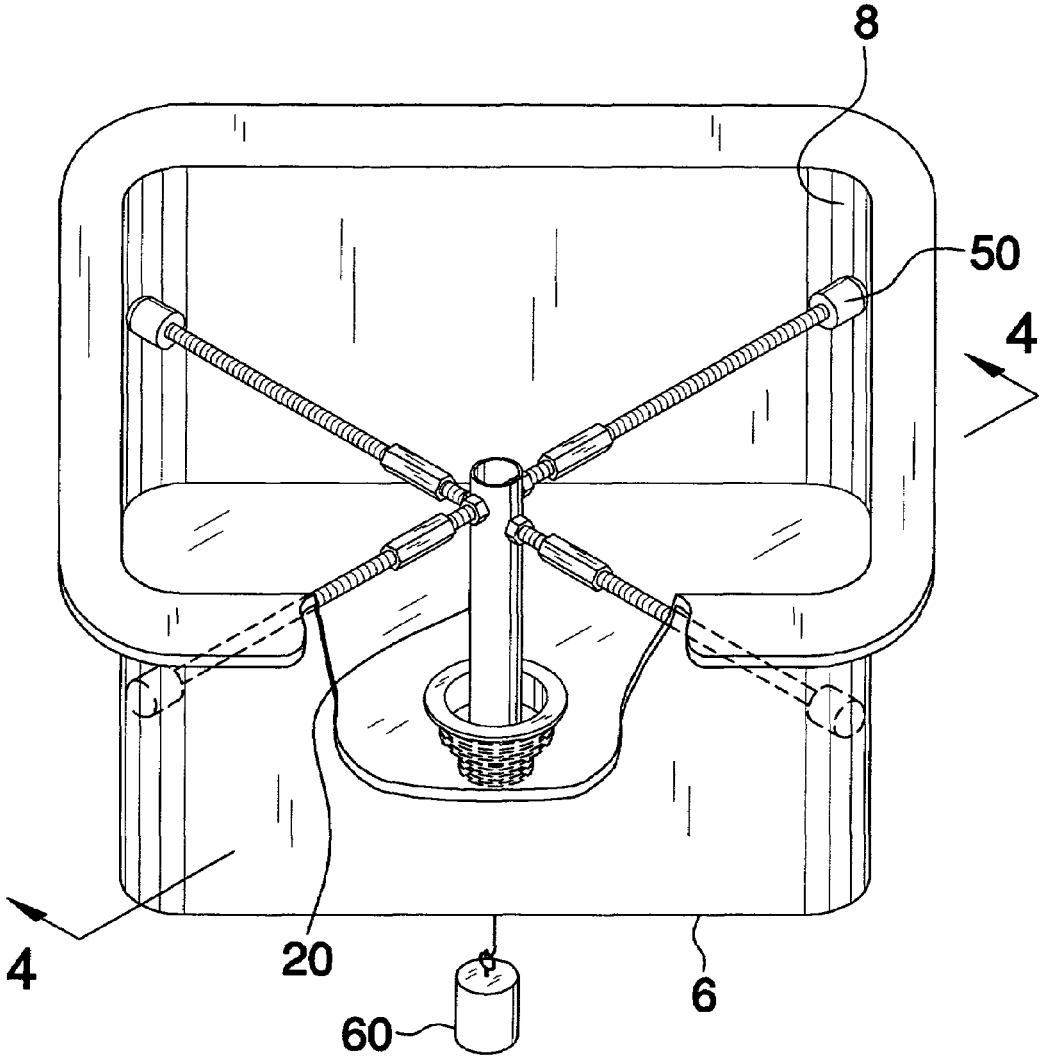
FIG. 1 is a perspective in-use view of a drain basket support tool according to the present invention.
Figure 2:
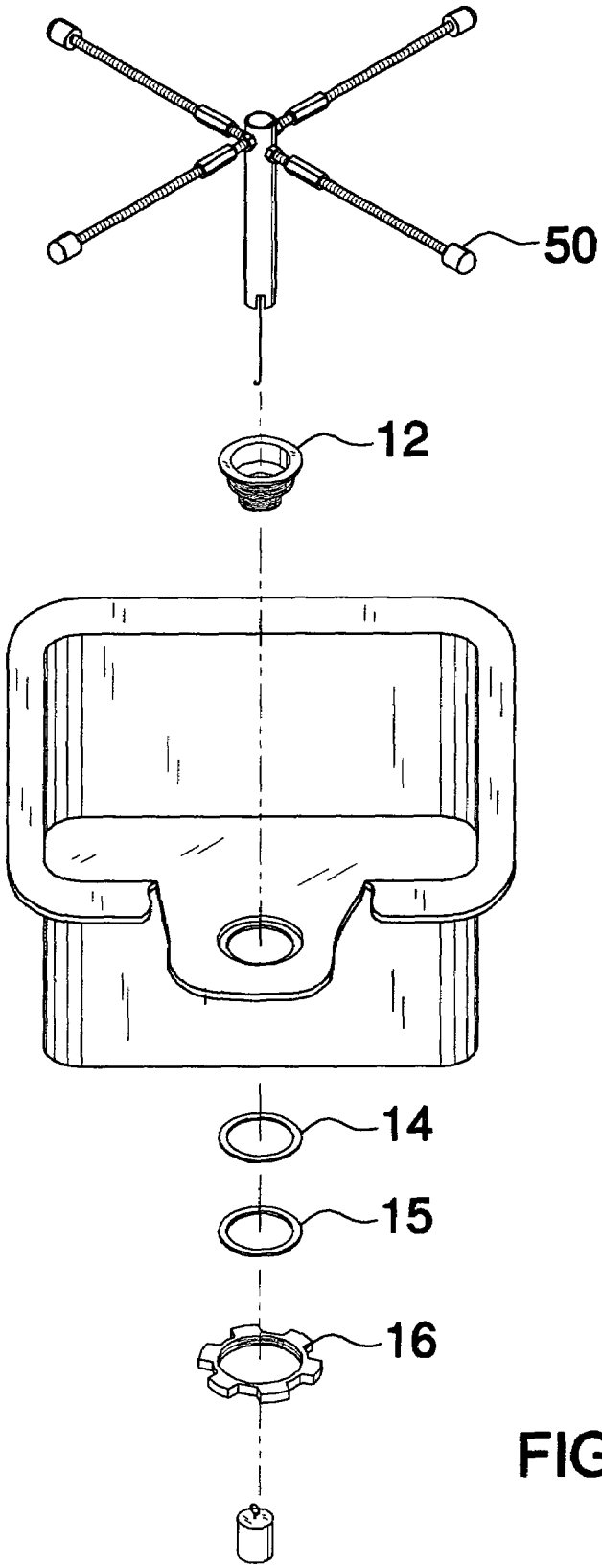
FIG. 2 is a perspective view of the present invention.
Figure 3:
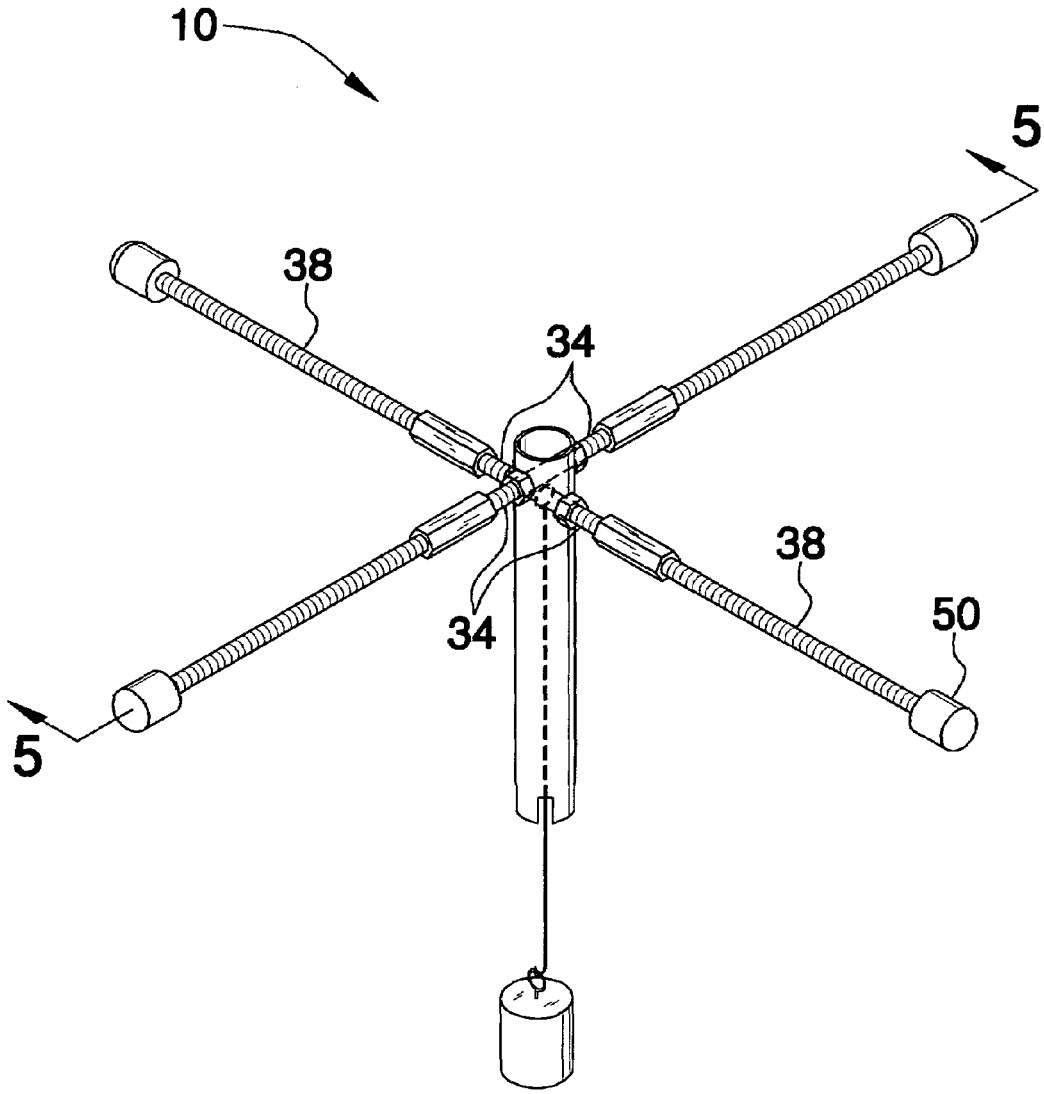
FIG. 3 is a perspective view of the present invention.
Figure 4:
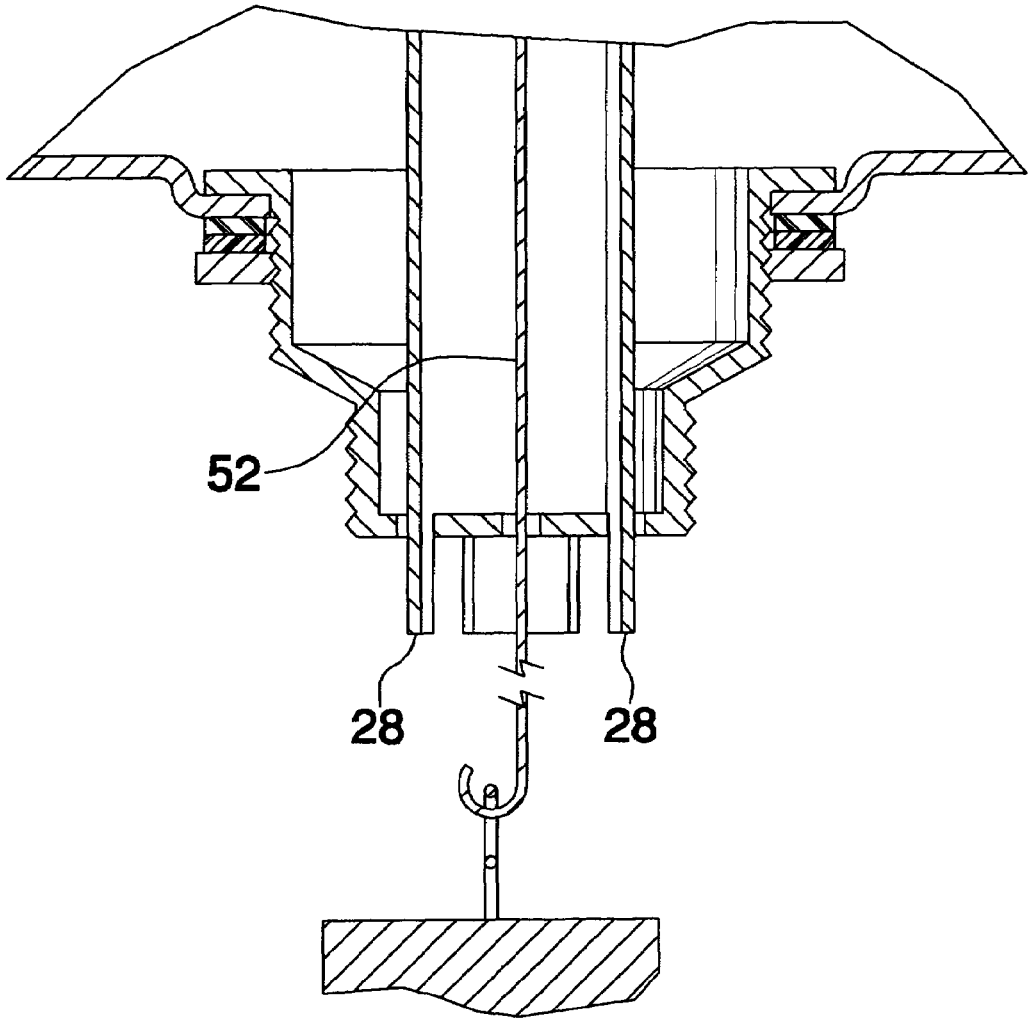
FIG. 4 is a cross-sectional view taken along 4—4 of FIG. 1 of the present invention.
Figure 5:
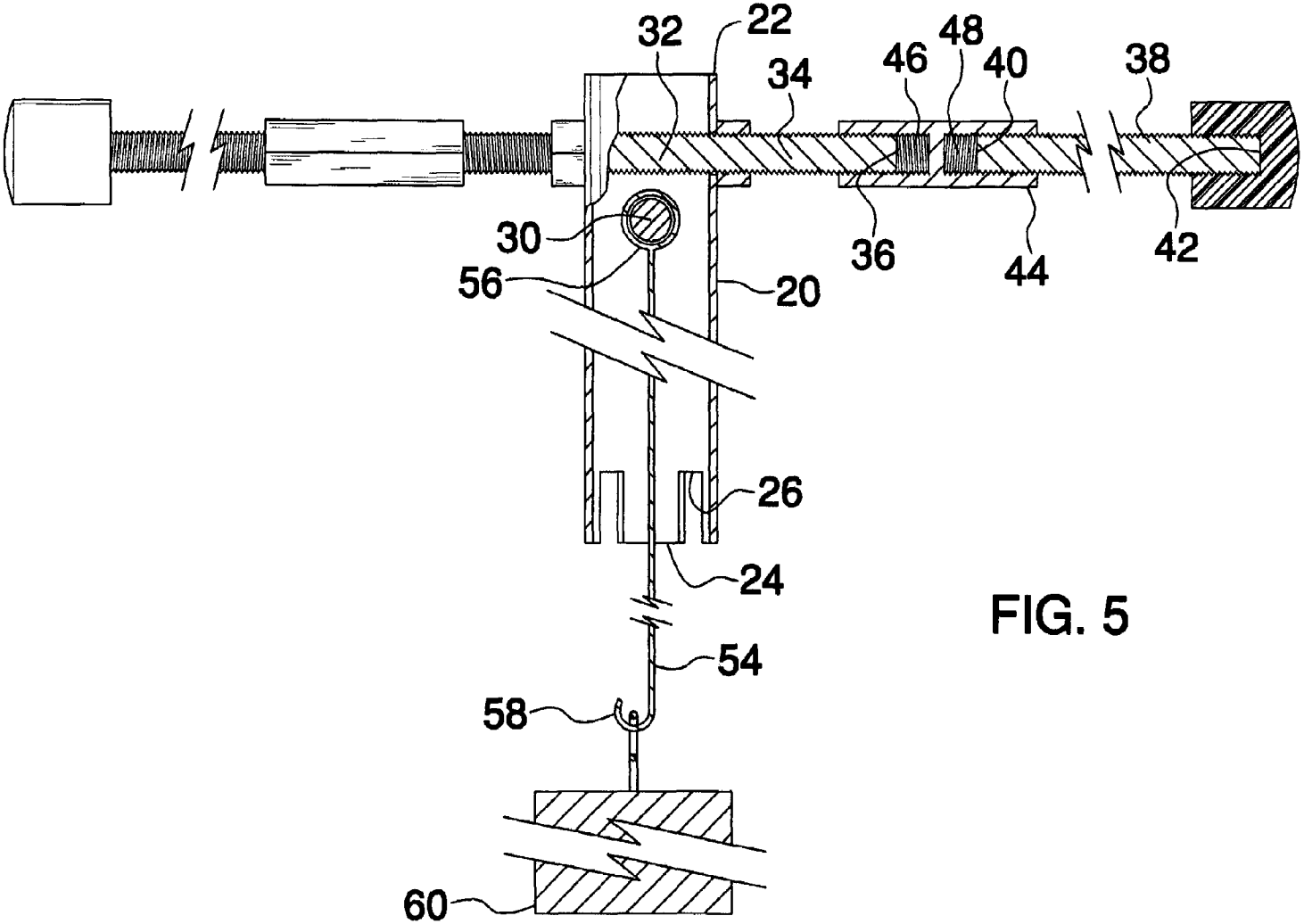
FIG. 5 is a cross-sectional view taken along line 5—5 of FIG. 3 of the present invention.

With reference now to the drawings, and in particular to FIGS. 1 through 5 thereof, a new plumbing tool embodying the principles and concepts of the present invention and generally designated by the reference numeral 10 will be described.

As best illustrated in FIGS. 1 through 5, the drain basket support tool 10 generally comprises a device for supporting a drain basket 12 and coupler assembly during installation or removal of the drain basket 12 and coupler assembly. The coupler assembly typically includes a rubber gasket 14, a paper gasket 15 and a nut 16. The tool 10 includes a tubular housing 20 that has a top end 22 a bottom end 24. The bottom end 24 has a plurality of notches 26 therein. The tubular housing 12 has a height generally between 5 inches and 9 inches.

Each of a pair of rods 30, 32 extends through the tubular housing 20. The rods 30 and 32 are orientated generally perpendicular to each other. Each of the rods 30, 32 includes a pair of arms 34 extending outwardly away from the tubular housing. The rods are preferably threaded along their length and threadably coupled to the tubular housing 20 so that their lengths can be adjusted with respect to the housing 20. The arms 34 each have a free end 36. A plurality of extension members 38 is provided. The extension members 38 are each elongated and each has a first end 40 and a second end 42. Each of a plurality of couplers 44 is adapted coupling together one of the free ends 36 of the arms 34 and one of the first ends 40 of the extension members 38 such that a length of each of the arms 34 and an associated one of the extension members 38 may be selectively adjusted. The couplers 44 each comprise a pair of axially aligned threaded female receivers 46, 48. A first one 46 of the pair of threaded female receivers is adapted for receiving and threadably coupling to one of the free ends 36, and a second one 48 of the pair of threaded female receivers is adapted for receiving and threadably coupling to one of the first ends 40 of the extension members 38.

It is preferred that the tool includes a plurality of cushion members 50 which are comprised of a resiliently compressible material such as an elastomer. Each of the cushion members 50 is attached to and covers one of the second ends 42 of the extension members 38.

A flexible tether 52 has an upper end 54 a lower end 56. The upper end 54 is positioned within the tubular housing 12 and is attached to one of the rods 30, 32. The lower end 54 extends away from the rods 30, 32 and outward through the bottom end 24 of the housing 20. A fastener 58 is attached to the lower end 56 of the tether 52. The fastener 58 preferably includes a hook. A weight 60 is removably attached to the fastener 58. A loop is attached to the weight 60 for removably receiving the hook.

In use, each of the extension members 38 may be selectively extended such that the second ends 42, or cushions 50, abut side walls 8 of a sink 6, and more preferably abut the corners of the sink 6. This supports the housing 20 in an upright manner. It is preferred that the bottom end 24 of the housing 20 is removably positioned such that sections 28 of the tubular housing 20 between the notches 26 extend through openings in the drain basket 12. This offers further stability for the housing 20 and the basket 12. The housing 20 holds the drain basket 12 down while the sections 28 prevent its movement and rotation. This aids in the installation and removal of the drain basket 12. The tether 52 is extended through a central area of the drain basket 12. The tether 52 is then selectively extended through the coupler assembly 14–16 so that the coupler assembly 14–16 is supported on the tether 52 between the weight 60 and the drain basket 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for supporting a drain basket and coupler assembly during installation or removal of the drain basket and coupler assembly, said device comprising:

a tubular housing having a top end a bottom end;

a pair of rods, each of said rods extending through said tubular housing, wherein each of said rods includes a pair of arms extending outwardly away from said tubular housing, each of said arms having a free end;

a plurality of extension members, each of said extension members being elongated and having a first end and a second end;

a plurality of couplers, each of said couplers being adapted coupling together one of said free ends of said arms and one of said first ends of said extension members such that a length of each of said arms and an associated one of said extension members may be selectively adjusted, wherein each of said extension members may be selectively extended such that said second ends abut side walls of a sink;

a flexible tether having an upper end a lower end, said upper end being positioned within said tubular housing and attached to one of said rods, said lower end extending away from said rods and outward through said bottom end of said housing;

a fastener being attached to said lower end of said tether;

a weight being removably attached to said fastener; and wherein said bottom end of said housing is abutted against the drain basket and said tether extends through a central area of the drain basket such that the drain basket is secured in place, and wherein the tether is selectively extended through the coupler assembly such that the coupler assembly is supported on the tether between said weight and the drain basket.

2. The device according to claim 1, wherein said bottom end has a plurality of notches extending therein.

3. The device according to claim 1, wherein said rods are orientated generally perpendicular to each other.

4. The device according to claim 1, wherein each of said couplers comprises a pair of axially aligned threaded female receivers, a first one of said pair of threaded female receivers being adapted for receiving and threadably coupling to one of said free ends, a second one of said pair of threaded female receivers being adapted for receiving and threadably coupling to one of said first ends of said extension members.

5. The device according to claim 1, further including a plurality of cushion members, each of said cushion members being attached to and covering one of said second ends of said extension members.

6. A device for supporting a drain basket and coupler assembly during installation or removal of the drain basket and coupler assembly, said device comprising:

a tubular housing having a top end a bottom end, said bottom end having a plurality of notches therein, said tubular housing having a height generally between 5 inches and 9 inches;

a pair of rods, each of said rods extending through said tubular housing and being orientated generally perpendicular to each other, wherein each of said rods includes a pair of arms extending outwardly away from said tubular housing, each of said arms having a free end;

a plurality of extension members, each of said extension members being elongated and having a first end and a second end;

a plurality of couplers, each of said couplers being adapted coupling together one of said free ends of said arms and one of said first ends of said extension members such that a length of each of said arms and an associated one of said extension members may be selectively adjusted, wherein each of said extension members may be selectively extended such that said second ends abut side walls of a sink, each of said couplers comprising a pair of axially aligned threaded female receivers, a first one of said pair of threaded female receivers being adapted for receiving and threadably coupling to one of said free ends, a second one of said pair of threaded female receivers being adapted for receiving and threadably coupling to one of said first ends of said extension members;

a plurality of cushion members, each of said cushion members being attached to and covering one of said second ends of said extension members;

a flexible tether having an upper end a lower end, said upper end being positioned within said tubular housing and attached to one of said rods, said lower end extending away from said rods and outward through said bottom end of said housing;

a fastener being attached to said lower end of said tether;

a weight being removably attached to said fastener; and wherein said bottom end of said housing is positioned such that sections of said tubular housing positioned between said notches are removably extended through openings in the drain basket and said housing abuts the basket, wherein said tubular housing secures the drain basket in place, said tether being extended through a central area of the drain basket, and wherein the tether is selectively extended through the coupler assembly such that the coupler assembly is supported on the tether between said weight and the drain basket.

* * * * *